US008091258B1

(12) United States Patent
Davidson

(10) Patent No.: US 8,091,258 B1
(45) Date of Patent: Jan. 10, 2012

(54) WATER-ACTUATED NOVELTY DEVICE

(76) Inventor: Randall A. Davidson, Hawthorne, CA (US)

( * ) Notice: Subject to any disclaimer, the term of this patent is extended or adjusted under 35 U.S.C. 154(b) by 187 days.

(21) Appl. No.: 12/688,887

(22) Filed: Jan. 17, 2010

(51) Int. Cl.
*G09F 19/08* (2006.01)

(52) U.S. Cl. ..... 40/412; 428/13; 239/44; 239/36

(58) Field of Classification Search ..... 40/412; 446/154, 473; 472/128; 428/15, 17, 24, 428/26

See application file for complete search history.

(56) References Cited

U.S. PATENT DOCUMENTS

| | | | |
|---|---|---|---|
| 2,507,899 | A | 5/1950 | Gilowitz |
| 3,400,890 | A | 9/1968 | Gould |
| 3,861,991 | A | 1/1975 | Kim |
| 4,529,569 | A | 7/1985 | Palau |
| 4,574,792 | A | 3/1986 | Trick |
| 4,738,881 | A | 4/1988 | Lee |
| 4,919,981 | A | 4/1990 | Leavey |
| 4,928,881 | A | 5/1990 | Barlics |
| 4,986,531 | A | 1/1991 | Snaper |
| 5,077,102 | A | 12/1991 | Chong |
| 5,756,166 | A | 5/1998 | Shinohara |
| 5,946,835 | A | 9/1999 | Boyd |
| 6,389,718 | B1 | 5/2002 | Joo |
| 6,391,398 | B1 | 5/2002 | Pesu |
| 6,503,582 | B1 | 1/2003 | Nardoza |
| 6,830,733 | B2 | 12/2004 | Stanley |

*Primary Examiner* — Joanne Silbermann
*Assistant Examiner* — Shin Kim

(57) ABSTRACT

A device incorporating an erectile member that becomes erect upon being partially immersed in water. The erectile member is formed from a flexible tube that contains a hydrophilic material. The hydrophilic material swells when hydrated, pressurizing the tube and causing it to become erect. A decorative feature may be added to one end of the erectile member, such as a simulated flower blossom, and the device may be displayed in a vase. The device may be designed to return to its original drooping state once it has consumed all the water in the vase. Other features and embodiments are described herein.

12 Claims, 4 Drawing Sheets

WATER-ACTUATED NOVELTY DEVICE

CROSS-REFERENCE TO RELATED PATENT APPLICATIONS

Not applicable.

FEDERALLY SPONSORED RESEARCH

Not applicable.

SEQUENCE LISTING OR PROGRAM

Not applicable.

BACKGROUND

1. Field of Invention

This invention relates to novelty devices, specifically to water-actuated novelty devices that feature an erectile member.

2. Prior Art

Various novelty devices are known wherein the application of water causes the device to perform a mechanical function. For example, U.S. Pat. No. 4,529,569 to Palau discloses a method for making objects that expand when immersed in water. Both U.S. Pat. No. 6,389,718 to Joo and U.S. Pat. No. 5,946,835 to Boyd disclose ways of making an artificial flower that blooms when given water. And U.S. Pat. No. 4,986,531 to Snaper, et al. discloses a telescoping device that elongates when placed in water. None of these inventions, however, disclose a water-actuated flexible member that changes its state from flaccid to erect upon the application of water.

The present invention makes special use of a hydrophilic material placed inside a flexible tube. Upon absorbing water, the hydrophilic material swells; this internally pressurizes the tube, causing it to become erect. While the principle of internally pressurizing a flexible tube to induce erection is well-known in the arts, the present invention distinguishes itself by the technique used to achieve that result. For example, U.S. Pat. No. 4,574,792 to Trick discloses a penile implant that achieves erection by having a fluid pumped into it. While the penile implant requires the use of a pump, the erectile device of the present invention needs only the application of water.

One embodiment of the present invention is an artificial flower with an erectile stem. In this embodiment, a desirable feature is for the flower to be able to dispense a floral scent or other fragrance. Various inventors have sought to combine scent-dispensing mechanisms with artificial flowers. See, for example, U.S. Pat. No. 6,830,733 to Stanley, III; U.S. Pat. No. 5,077,102 to Chong; and U.S. Pat. No. 3,861,991 to Kim. However, none of these inventions describe a scent-dispensing mechanism combined with an artificial flower that has an erectile stem.

SUMMARY

A new type of erectile device is disclosed herein. The device includes a flexible tube that contains a hydrophilic material. When the tube is partially immersed in water, the hydrophilic material swells, pressurizing the tube and causing it to become erect.

The erectile device may be shaped like a flower, or it may incorporate other shapes so as to resemble an animal, a fictional character, a nonfictional person, a fanciful creature such as a monster, or any other representation deemed desirable.

Among the chief goals of the erectile device are to provide amusement, to serve as a decorative object, and to act as a fragrance dispenser. These and other applications are described below.

DRAWINGS

Figures

REFERENCE NUMERALS

| | |
|---|---|
| 10 | erectile member |
| 11 | water |
| 12 | vase |
| 13 | decorative weight |
| 20 | flexible tube |
| 21 | hydrophilic particle |
| 22 | filler material |
| 30 | plug |
| 31 | wick |
| 32 | another type of wick |
| 33 | seal |
| 40 | kink in erectile member |
| 41 | monofilament line |
| 42 | coil |

DETAILED DESCRIPTION

General Appearance and Operation

Figure 1:
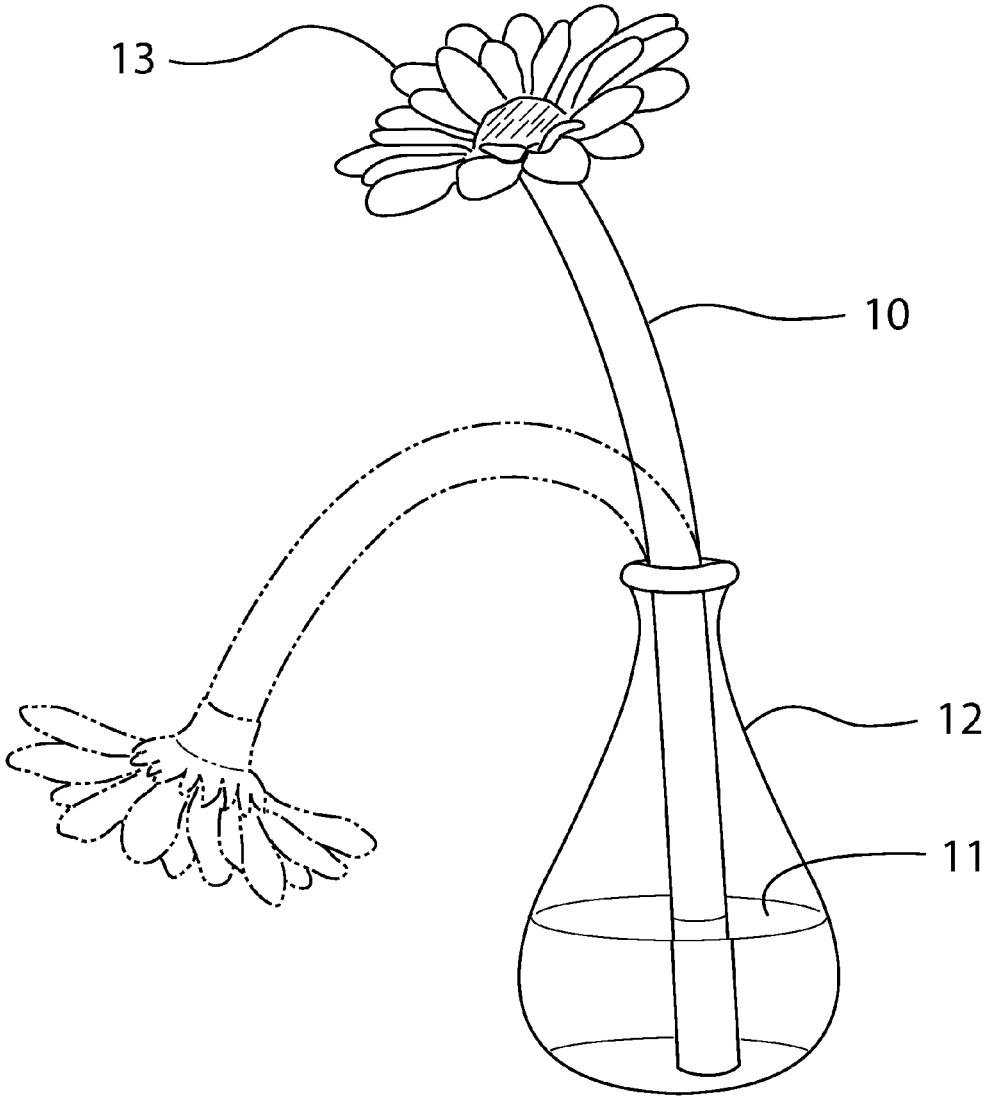
FIG. 1 shows one embodiment of the erectile device with its erectile member representing the stem of a flower. The erectile member is shown in two states: erect (indicated by solid lines) and flaccid (indicated by phantom lines).

One embodiment of the erectile device is illustrated in FIG. 1. In this embodiment, the erectile device has been designed to resemble a flower, with its erectile member 10 representing the stem of the flower.

Initially, the erectile device is in a drooping or flaccid state, as indicated by phantom lines in the drawing. Water 11 is added to a vase 12, and the erectile device is placed with the lower end of its erectile member in the vase. Upon absorbing the water, the erectile member becomes substantially upright or erect, as shown. Depending on the materials selected for its construction, this process can take anywhere from a number of minutes to several hours. In some embodiments discussed below, the erectile member will gradually return to a flaccid state once it has consumed all the available water; it may then be rehydrated, so that the cycle of rising and falling can be repeated indefinitely.

A decorative weight 13, in this case shaped like a flower blossom, is situated at the upper end of the erectile member. The weight ensures that the erectile member fully bends or droops when flaccid. Note that the weight need not be decorative or even visible. For example, it may be desirable in certain embodiments to conceal the weight in the upper end of the erectile member, and to color the erectile member decoratively instead of adorning it with three-dimensional features. In other embodiments wherein the weight is decorative, the weight may be shaped like a flower, as noted, or like an animal, a fictional character, a nonfictional person, a fanciful creature such as a monster, or any other representation deemed desirable.

Composition and Construction

Figure 2:
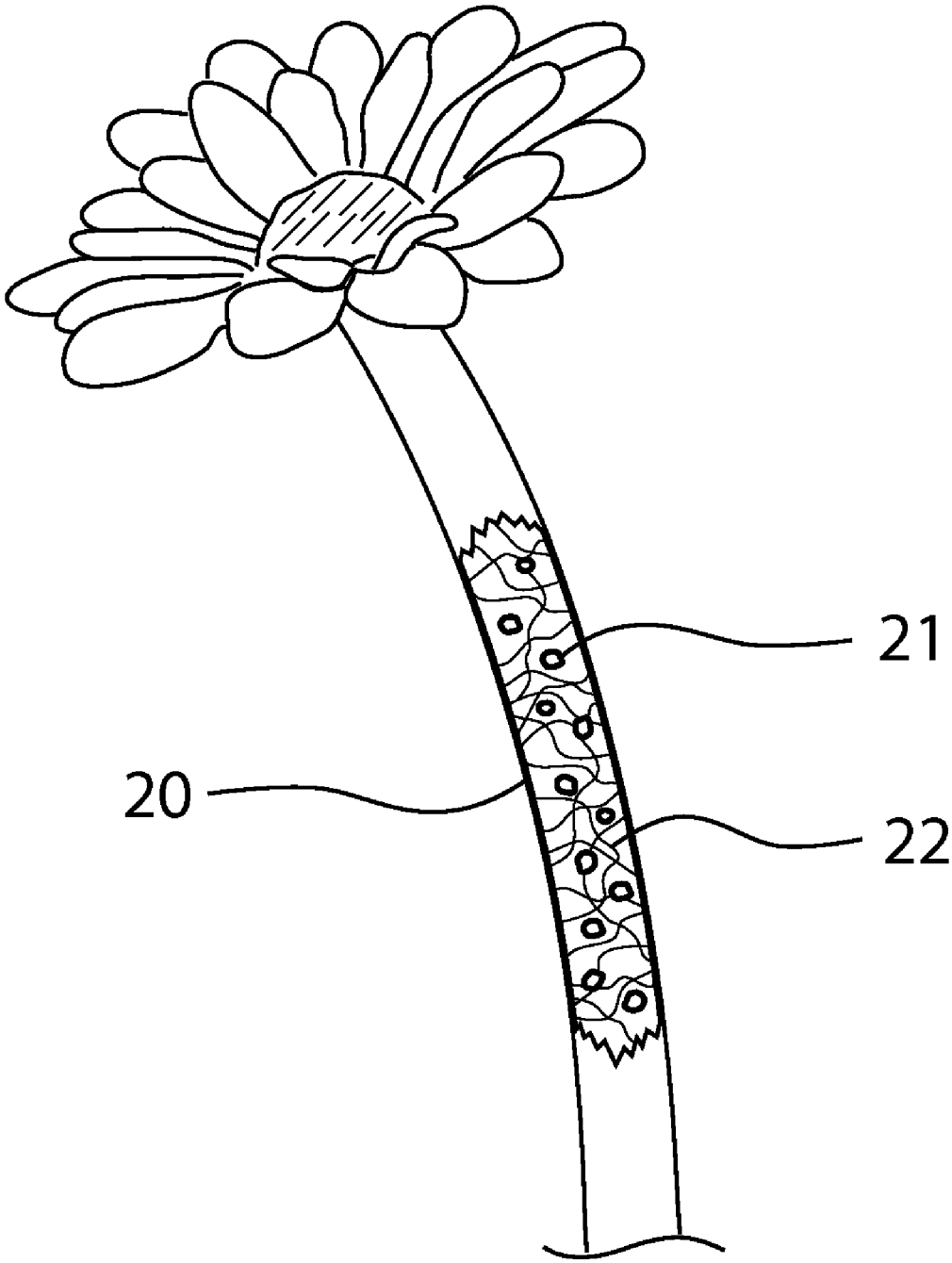
FIG. 2 shows a cutaway view of a section of the erectile member, revealing its contents.

FIG. 2 shows a cutaway section of the erectile member. The walls of the erectile member are formed by a flexible tube 20. A multitude of hydrophilic particles 21 are contained inside the flexible tube. When the particles become hydrated, they swell and exert pressure on the inside of the tube. Also inside the tube is a filler material 22, throughout which the hydrophilic particles are distributed. The filler material maintains an even distribution of the particles, and helps to keep them from settling during transportation, handling, and use.

If the flexible tube is used to represent the stem of a flower, it is contemplated that the tubing will have a diameter of about ¼ inch to ½ inch, depending on the size of the flower blossom. The material from which the flexible tube is made may be porous or non-porous, depending on the desired result. For example, let us assume that the erectile member has been hydrated using a limited supply of water (e.g., water from a vase) and is now fully upright. If the tubing is porous, the water absorbed by the erectile member will slowly evaporate through it, causing the erectile member to wilt unless rehydrated. This may be a desirable feature in certain designs. If, on the other hand, it is preferred that the erectile member remain upright for a more extended period of time, the flexible tube should be made from a non-porous material. This tends to retain the water and keep the erectile member upright.

If the flexible tube is non-porous, it may be made from any suitably flexible material, such as polychloroprene or latex tubing. If it is porous, it may be made from a woven or non-woven fabric, selected both for its flexibility and its ability to contain the hydrophilic particles when they swell. For example, in one embodiment, a ⅜-inch diameter tube may be constructed from a point-bonded, spunbond polyester fabric having a weight of about 1.25 ounces per square yard, with the largest pores or openings in the fabric being on the order of 50 to 75 microns. This fabric weight achieves a good combination of porosity and flexibility for the size of the tube (denser fabrics may be used for larger, heavier articles). The fabric in this case may be formed into a tube by methods such as heat-sealing, ultrasonic welding, or cementing a seam that runs along its length. These are preferred to sewing, which introduces needle holes through which the hydrophilic particles, when hydrated and in gel form, can leak.

Figure 3:
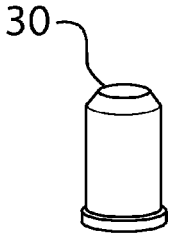
FIG. 3 shows a plug that can be used to seal the ends of the erectile member.
Figure 4:
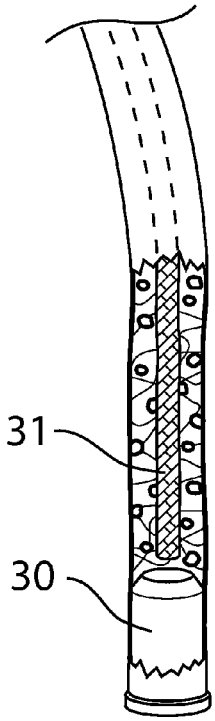
FIG. 4 shows a cutaway view of a section of the erectile member, revealing an optional wick contained inside.

FIG. 3 shows a plug 30 that can be used to seal the ends of the flexible tube; the plug is shown situated at the lower end of the flexible tube in FIG. 4. The plug can be cemented in place or secured with a mechanical fastener such as a nylon cable tie or simply a piece of string. The ends of the tube can alternatively be sealed without using such a plug (not shown). For example, the tubing can be folded or pinched together and then heat-sealed, cemented, or secured using various mechanical closures such as a ferrule, wire-wrap, nylon cable tie, or string. Once again, techniques such as these are preferred to sewing, which can introduce needle holes through which the hydrophilic particles may leak.

The hydrophilic particles are a superabsorbent polymer such as crosslinked polyacrylamide, but other types of superabsorbent polymer can be used. In one embodiment, the particles when dry are about 1 to 3 mm in size, but particles that are larger or smaller could be used. The optimal choice depends on the size of flexible tube and the material from which it's constructed. Particles that are too large may bind against each other when dry and hinder the tube's flexibility, especially for smaller-diameter tubes; in addition, they create an unpleasant tactile sensation when the tube is handled (hard granules inside an otherwise soft article). Particles that are too small (e.g., powder-size) may leak, depending on the porosity of the flexible tubing.

The hydrophilic particles are mixed with a filler material that is designed to keep them evenly distributed. The filler material must be flexible (to allow the erectile member to bend) and must also allow water to reach the hydrophilic particles. It is found that fiberfill (a stuffing material, usually made from polyester, commonly used to fill pillows, dolls, and stuffed animals) works well for this purpose.

Wicking Means

If the erectile member is intended to be partially immersed in water (as when it represents the stem of a flower), then a wicking means is required to deliver the water to the hydrophilic particles at the upper end of the erectile member. Such a wicking means can take several forms. FIG. 4 shows a section of an erectile member whose flexible tube is made from a porous material. Since the tubing is porous, a wick 31 can be contained entirely inside the flexible tube. When water penetrates the lower portion of the flexible tube, it comes into contact with the wick, and is transported by the wick to the upper extremities of the erectile member.

Figure 5:
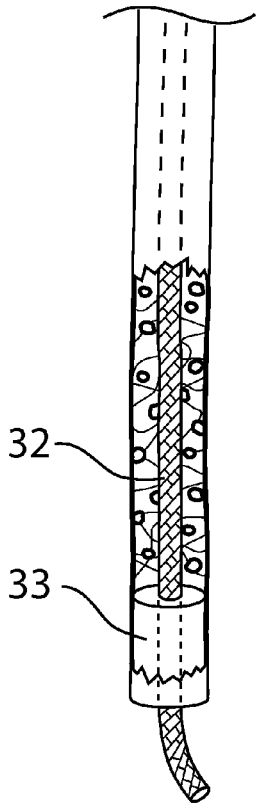
FIG. 5 shows a cutaway view of a section of the erectile member, revealing an optional wick that extends outside the erectile member at one end.

Alternatively, FIG. 5 shows a section of an erectile member whose flexible tube is made from a non-porous material. Since the tubing is non-porous, water must be received outside the tube and brought inside. A wick 32 extends outside the bottom of the tube where it receives water. A seal 33 fits around the wick in order to contain the hydrophilic particles inside the tube. The seal can be made, for example, from an open- or closed-cell foam plastic and then cemented to the flexible tubing to hold it in place.

Yet another method of transporting water is for the flexible tube itself to serve as a wick, obviating the necessity for having a separate or discrete wick. In this case, the material from which the flexible tube is made should be porous and composed of fibers that lend themselves to wicking, such as a woven or nonwoven fabric. Yet another alternative is for the filler material (the material in which the hydrophilic particles are distributed) to serve as a wick.

Depending on the desired speed with which the erectile member is to function, the wicking means can be made from a combination of any of the above-mentioned wicking materials or means.

Whatever the wick's specific form, it may be necessary to treat it to enhance its hydrophilicity (wicking ability), depending on the material from which it's made. For example, synthetic fabrics such as polyester and polypropylene are naturally hydrophobic and need to be treated. This can be accomplished by a variety of techniques generally known as surface modification, such as plasma treatment or chemical grafting. Plasma treatment can be used by itself, or it can be used to pretreat the material in preparation for surface graft polymerization (the attachment of synthetic monomers to peroxide groups established by the plasma treatment). Generally speaking, surface graft polymerization provides a more durable, longer-lasting result than plasma treatment alone, but at greater expense. Yet another method to improve wicking ability is to use fibers whose cross-sectional shape is designed to transport moisture; such fibers have capillary-like channels that run their length, and are well-known in the field of fiber engineering.

Anti-Kinking Means

Figure 6:
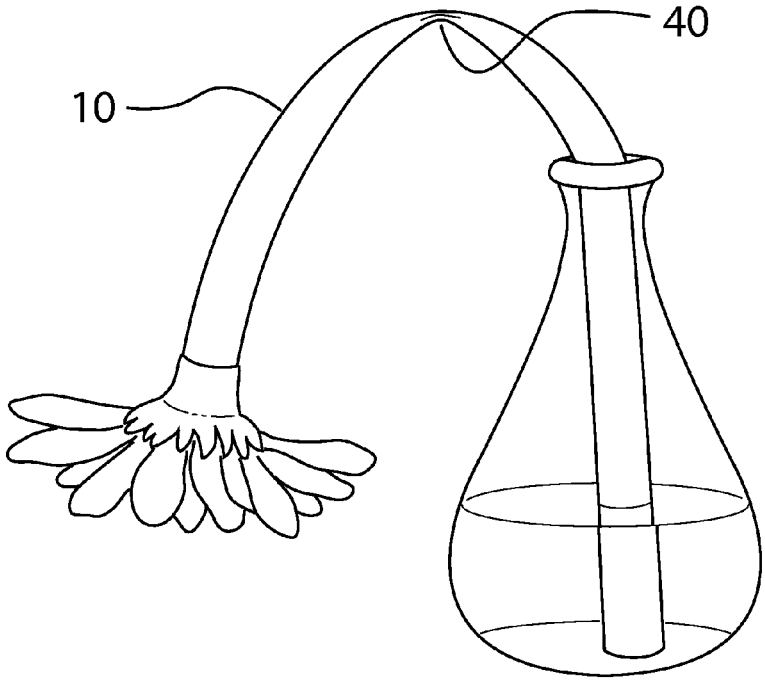
FIG. 6 shows a crease or kink that has formed in the erectile member.

One esthetic concern in the design of the erectile member is that it should bend gracefully when flaccid, without forming an unattractive crease or kink. For example, FIG. 6 shows a crease or kink 40 that has formed in erectile member 10. Such a kink may also cause mechanical difficulty by making it more difficult for the upper end of the erectile member to become erect. Therefore, it is preferred that the erectile member should bend in a smooth arc, as seen in FIG. 1. This can be accomplished by adding an anti-kinking means, which may take various forms.

Figure 7:
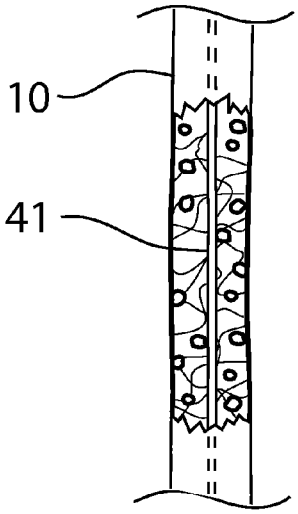
FIG. 7 shows an anti-kinking means in the form of a monofilament line contained inside the erectile member.

FIG. 7 shows a straight piece of monofilament line 41 contained inside erectile member 10 (similar to nylon trimmer line used by garden edgers). The monofilament line acts like a spring to keep the erectile member from bending at too sharp an angle.

Figure 8:
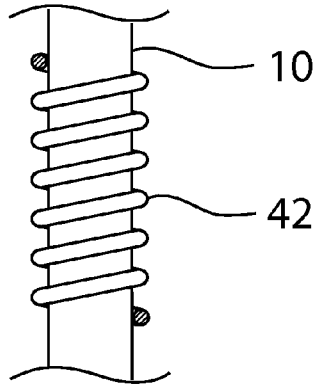
FIG. 8 shows an anti-kinking means in the form of a coil wrapped around the outside of the erectile member.

Alternatively, FIG. 8 shows a flexible, springlike coil 42 that wraps around the erectile member and provides auxiliary support. The coil could be made from plastic or metal; it could wrap around the outside of the erectile member, as shown, or it could be placed inside; and it could run the entire length of the erectile member, or just part-way. In yet another alternative (not shown), a braided tubular sheath is formed from monofilament line, or a combination of a monofilament and other decorative materials such as metallized polyester ribbon. The monofilament provides the necessary springiness to prevent kinking. The sheath fits outside the erectile member, like springlike coil 42 as depicted in FIG. 8. Such a sheath has the advantage of keeping the erectile member from kinking while adding minimal additional thickness—a possible esthetic advantage. In addition, it affords a hydrophobic covering to the article, allowing it to remain dry to the touch even when the erectile member is fully hydrated.

Scent

Particularly if the erectile member is used to represent the stem of a flower, it is desirable for it to be able to dispense a floral scent or other fragrance. Such a scent can be incorporated in various ways. For example, the scent can be applied directly to the flower-shaped decorative weight 13. If the erectile member is made from a porous material, a water-soluble fragrance can be incorporated into the erectile member during manufacture (for example, scented granules can be mixed with the hydrophilic particles before they are used to fill the flexible tubing); when the erectile member is hydrated, the scented granules dissolve and the scent is released into the air evaporatively through the porous walls of the tubing. In yet another alternative, a water-soluble fragrance may be placed in vase 12. When water is introduced into the vase, the fragrance dissolves into the water, is absorbed by the erectile member, and transpires through the porous walls of the erectile member.

CONCLUSIONS, RAMIFICATIONS, AND SCOPE

In one embodiment of the erectile device, the erectile member represents the stem of an artificial flower. This particular embodiment has several advantages:

- It effectively simulates the life-like quality of an actual flower stem, which can rise or fall depending on the amount of water provided.
- The cycle of rising and falling can be repeated indefinitely.
- It specifically uses water as its actuator, just like a living plant.
- By requiring additional water when it wilts, it invokes the human desire to nurture living things and affords the owner an opportunity to care for it as if it were a real plant.
- Its operation is simple: just add water. Furthermore, its design avoids needless complexity; its operation doesn't rely on motors, batteries, or other electromechanical contrivances, which would render the design inelegant.
- It can be given the ability to dispense a fragrance, just like a real flower.

Besides the flower-shaped embodiment discussed above, other shapes can be incorporated into the design to make it resemble an animal, a fictional character, a nonfictional person, a fanciful creature such as a monster, or any other representation deemed desirable.

From the foregoing discussion, it will be appreciated that among the chief goals of the erectile device are to provide amusement, to serve as a decorative object, and to act as a fragrance dispenser. Additional practical applications are also envisioned. For example, if the erectile member is inserted into soil, it can be used as an instrument to gauge the amount of moisture in the soil and thus provide a benefit to gardeners. To facilitate this application, a rigid tip can be added to the base of the erectile member to allow it to be easily inserted into soil (or into floral foam or any other semi-firm medium). Additionally, owing to the resemblance of the present invention to the male anatomy, it can be used as an educational tool to demonstrate the scientific principles underlying male physiology.

Although the descriptions above contain many specifics, they should not be construed as limiting the scope of the embodiments but as merely providing illustrations of some of the presently preferred embodiments. Thus the scope of the embodiments should be determined by the appended claims and their legal equivalents, rather than by the examples given.

I claim:

1. An erectile device featuring a water-actuated erectile member, comprising:

(a) a flexible tube having two ends, upper and lower, said tube being closed or sealed at each end, and the walls of the tube being formed from a porous material that can allow water to pass in or out of the tube, (b) a multitude of hydrophilic particles contained inside the flexible tube that can absorb water and swell, so as to pressurize the inside of the tube and cause it to become erect, (c) a filler material contained inside the flexible tube, with the hydrophilic particles distributed throughout the filler material, so that the filler material helps to maintain an even distribution of said particles during transportation, handling, and use, (d) a wicking means capable of absorbing water where it is received at the lower end of the flexible tube and delivering the water to the hydrophilic particles along the entire length of the tube, and (e) a weight located at the upper end of the flexible tube of sufficient mass to cause the tube to bend or droop when it is not internally pressurized, whereby the erectile member, when dry, may be placed with its water-receiving lower end in a container of water, and with its weighted upper end hanging flaccid outside the container, and the erectile member's immersion in the water causes it to absorb the water and become erect.

2. The device of claim 1 wherein the porous material that forms the walls of the flexible tube is selected from the group consisting of woven and nonwoven fabrics.

3. The device of claim 2 wherein the porous material serves as both the walls of the flexible tube and as the wicking means, obviating the necessity for having a separate or discrete wick.

4. The device of claim 1 wherein the hydrophilic particles are a superabsorbent polymer.

5. The device of claim 1 wherein the filler material is a synthetic fiberfill.

6. The device of claim 1, wherein the weight comprises a decorative feature attached at the upper end of the erectile member.

7. The device of claim 6 wherein the decorative feature resembles an item selected from the group consisting of flower blossoms, animals, fictional characters, nonfictional persons, and fanciful creatures.

8. The device of claim 6, further including a scent or fragrance applied to the decorative feature.

9. The device of claim 1, further including an anti-kinking means to prevent the erectile member, when flaccid, from bending at such a sharp angle under its own weight as to crease or kink.

10. The device of claim 1, further including a water-soluble fragrant chemical contained inside the erectile member.

11. A method of dispensing scent that uses the device of claim 1, comprising:

(a) placing a water-soluble scent in a container of water, and (b) placing the device of claim 1 upright in the container of water, whereby the scent dissolves into the water, is carried by the water upward through the erectile member, and is then released into the surrounding air by evaporation through the porous material that forms the flexible tube of the erectile member.

12. An erectile device featuring a water-actuated erectile member constructed from a non-porous tube that is designed to remain erect for an extended period of time, comprising:

(a) a flexible tube having two ends, upper and lower, said tube being sealed at both ends, and the walls of the tube being formed from a non-porous material, (b) a multitude of hydrophilic particles contained inside the flexible tube that can absorb water and swell, so as to pressurize the inside of the tube and cause it to become erect, (c) a filler material contained inside the flexible tube, with the hydrophilic particles distributed throughout the filler material, so that the filler material helps to maintain an even distribution of said particles during transportation, handling, and use, (d) a wicking means that passes through the seal at the lower end of the flexible tube, such that the hydrophilic particles and filler material are maintained inside the tube, said wicking means being capable of absorbing water from outside the tube, introducing it into the lower end of the tube, and delivering it to the hydrophilic particles along the entire length of the tube, and (e) a weight located at the upper end of the flexible tube of sufficient mass to cause the tube to bend or droop when it is not internally pressurized, whereby the erectile member, when dry, may be placed with its water-receiving lower end in a container of water, and with its weighted upper end hanging flaccid outside the container, and the erectile member's immersion in the water causes it to absorb the water, become erect, and remain erect for an extended period of time owing to the inability of the water to evaporate through the non-porous material forming the flexible tube.

* * * * *